United States Patent [19]

Kline

[11] 3,975,227

[45] Aug. 17, 1976

[54] PRODUCT LABELLING MACHINE

[75] Inventor: Edward Kline, Montreal, Canada

[73] Assignee: V-Mark Automation Ltd., Montreal, Canada

[22] Filed: Feb. 28, 1975

[21] Appl. No.: 554,082

[52] U.S. Cl. ..... 156/361; 156/446; 156/458; 156/486; 156/542; 156/DIG. 11; 156/DIG. 45

[51] Int. Cl.[2] ..... B65C 3/10; B65C 9/42

[58] Field of Search ..... 156/361, 446, 447, 458, 156/486, 541, 542, DIG. 11, DIG. 13, 351, 363, 364; 198/219

[56] References Cited

UNITED STATES PATENTS

| | | | |
|---|---|---|---|
| 3,231,448 | 1/1966 | Flood | 156/542 |
| 3,580,790 | 5/1971 | Pollmeier et al. | 156/458 |
| 3,634,174 | 1/1972 | Warsager | 156/361 |
| 3,653,176 | 4/1972 | Gess | 156/542 |
| 3,815,726 | 6/1974 | Klein | 198/219 |

*Primary Examiner*—William A. Powell
*Assistant Examiner*—Basil J. Lewris
*Attorney, Agent, or Firm*—Alan Swabey & Co.

[57] ABSTRACT

This invention relates to an assembly for applying labels to the longitudinal surface of cylindrical articles. The assembly includes a label dispenser which carries the labels to a label station and dispenses them, one at a time, at the labelling station. The labels are carried on a backing tape and are slid off the tape at the labelling station. The assembly also includes means for advancing the articles to the labelling station, for example, a walking beam, and means for supporting the article at the labelling station so that it is free to rotate about its longitudinal axis. A cylindrical roller is disposed in a two position parallel arrangement with an article at the labelling station such that, in one position, the roller is spaced from the article and, in a second position, the roller is in physical contact with the article along a longitudinal contact line. Means are provided for moving the roller to its two positions, and further means are provided for rotating the roller about its longitudinal axis. The label dispenser is adapted to dispense a label adjacent to the contact line when the roller is in the second position. Thus, when the roller is in the second position, it will cause the article at the labelling station to rotate, and the label dispensed by the dispenser will be rolled around the longitudinal surface of the article at the labelling station. The pressure of the roller on the article will cause the label to adhere to the surface of the article.

5 Claims, 7 Drawing Figures

PRODUCT LABELLING MACHINE

BACKGROUND OF THE INVENTION

1. Field of the Invention

The invention relates to a labelling apparatus for applying labels to the longitudinal surface of cylindrical articles. More specifically, the invention relates to a labelling assembly which will automatically apply pressure sensitive labels to the longitudinal surface of the article.

2. Description of the Prior Art

Apparatus for applying labels, or other indicia, to the surfaces of articles, are well known in the art. However, the prior art apparatus are characterised by the complexity of their design which makes the apparatus expensive to purchase and difficult to maintain. In addition, many of the apparatus are designed as part of a larger apparatus and can only operate with this larger apparatus.

Apparatus for applying labels of which applicant is available are described in the following United States patents:

| | | |
|---|---|---|
| U.S. Patents | 2,981,432 | 3,111,446 |
| | 3,058,514 | 3,193,211 |
| | 3,064,714 | 3,208,897 |
| | 3,079,979 | 3,231,448 |
| | 3,261,734 | 3,540,968 |
| | 3,483,063 | |
| U.S. Patent | 2,367,189 | |
| U.S. Design | 226,592 | |

SUMMARY OF THE INVENTION

The instant disclosure teaches a labelling assembly which is mechanically simple and which performs the labelling operation reliably and accurately.

In accordance with the invention, a labelling assembly for applying pressure-sensitive labels to the longitudinal surfaces of cylindrical articles comprises;

label dispensing means for carrying labels to a labelling station and for dispensing the labels, one at a time, at the labelling station;

means for advancing said articles to said labelling station;

means for supporting a first article at the labelling station so that the article is free to rotate about its longitudinal axis;

a cylindrical roller means disposed in a two position parallel arrangement with said first article wherein, in one position, said roller is spaced from said one article, and, in the second position, is in physical contact, along a longitudinal contact line, with said first article;

means for moving said cylindrical roller from the first position to the second position and from the second position to the first position;

means for rotating the roller about the longitudinal axis of the roller;

said label dispensing means being adapted to dispense a label adjacent to said contact line when said roller is in said second position;

whereby, when said roller is in said second position, it will cause said article to rotate about its longitudinal axis, and the label dispensed by said dispensing means will be rolled around the longitudinal surface of the first article and will be caused to adhere to said longitudinal surface by the pressure of said roller against said first article.

BRIEF DESCRIPTION OF THE DRAWINGS

The invention will be better understood by an examination of the following description, together with the accompanying drawings, in which.

DETAILED DESCRIPTION OF THE DRAWINGS

Figure 1:
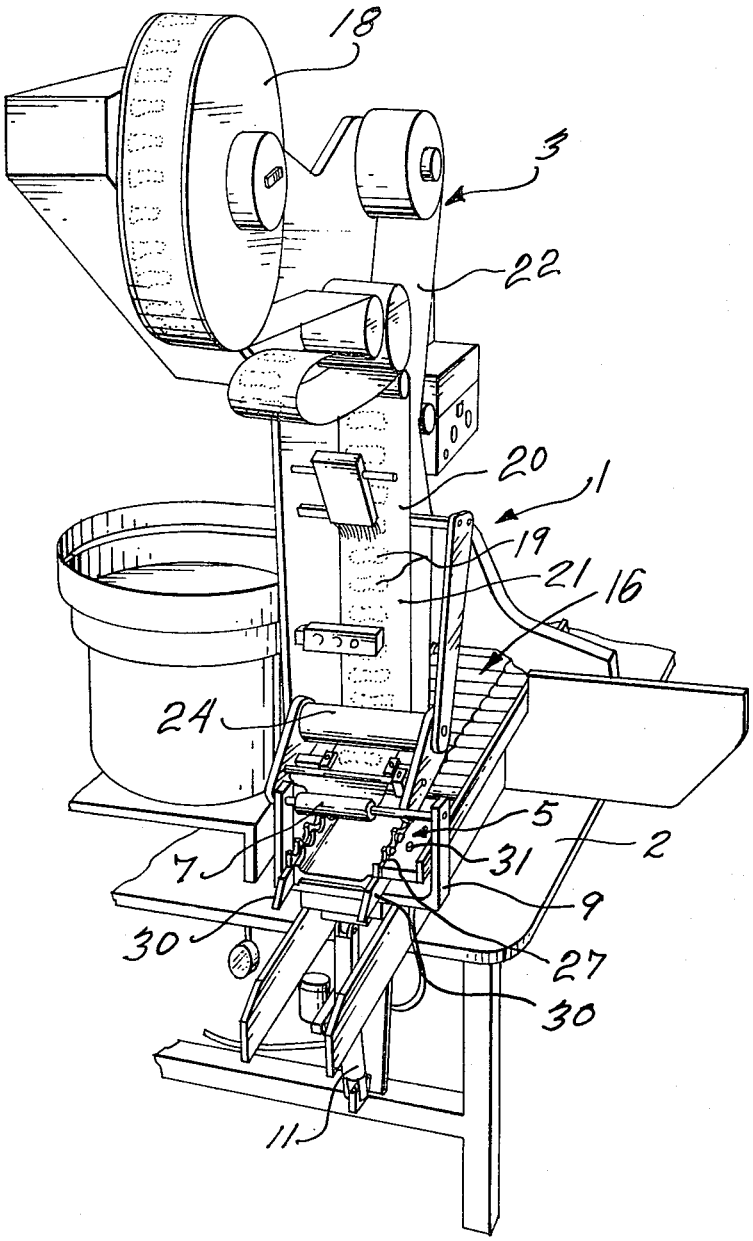
FIG. 1 is a perspective view of the labelling assembly.
Figure 3:
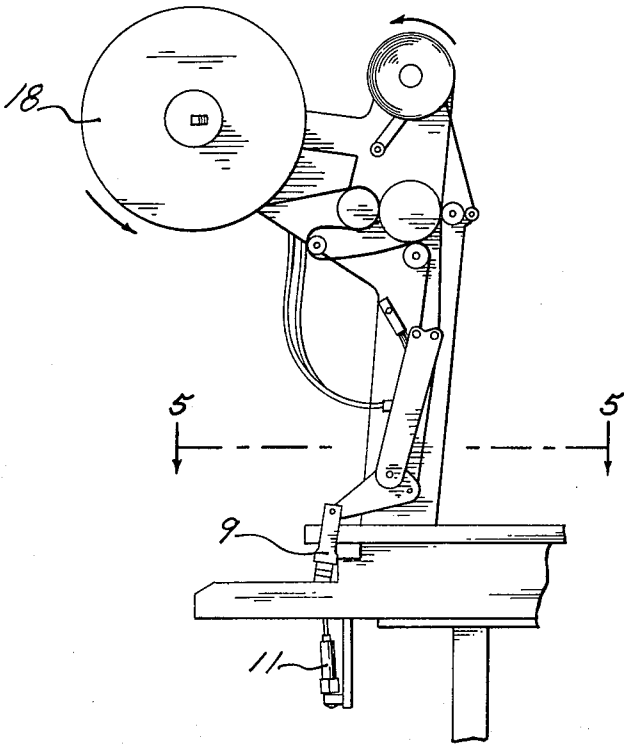
FIG. 3 is a side view of the assembly.
Figure 2:
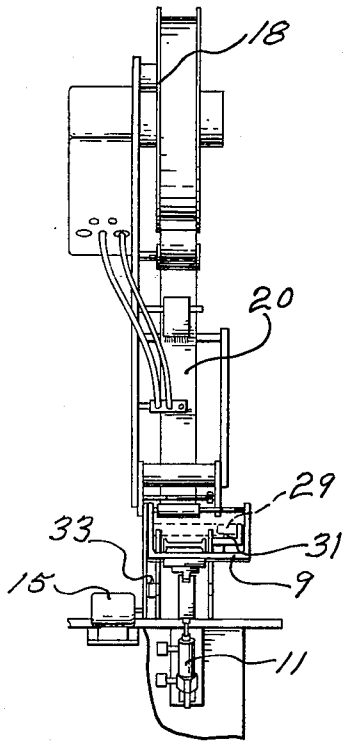
FIG. 2 is a front view of the assembly.
Figure 5:
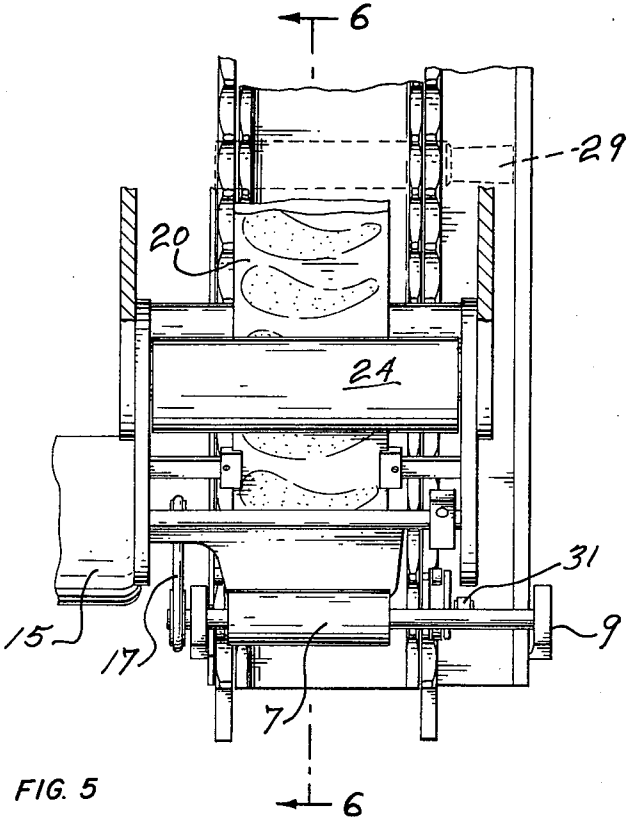
FIG. 5 is a section along 5—5 of FIG. 3.

Referring to the drawings, FIG. 1 shows the assembly, indicated generally at 1 and mounted on a table, or other carrying means 2. The assembly comprises a label dispenser 3 of a well known type, for example, for dispensing labels at a labelling station 5. The assembly further includes a rotatable roller means 7, which is cylindrical in shape and mounted to rotate about its longitudinal axis on a U-shaped bracket 9. The bracket is connected to a pull-down means, shown in the drawings as a piston and cylinder arrangement 11. The piston and cylinder arrangement 11 may be hydraulically actuated as well known in the art. The arrangement 11 is better seen in FIGS. 3, 4, 6*a* and 6*b*. The roller is rotated by a motor 15 through a pulley arrangement 17 shown in FIG. 4.

Article advancing means 16, to be further discussed below, is provided to carry articles to the labelling station 5.

Considering the above elements in greater detail, the dispenser comprises a roll 18 which carries pressure sensitive labels 19 on a backing tape 21. As is well known, the labels are pre-prepared so that, when they are removed from the backing tape, they will adhere to a surface with the mere application of pressure. The surface of the label adjacent the backing tape is the gummed surface and the surface which adheres to the surface on which the label is applied. The tape extends along a feed route 20, wherein the labels are carried on the tape, and a return route 22, wherein the labels have been removed from the tape.

Figure 6A:
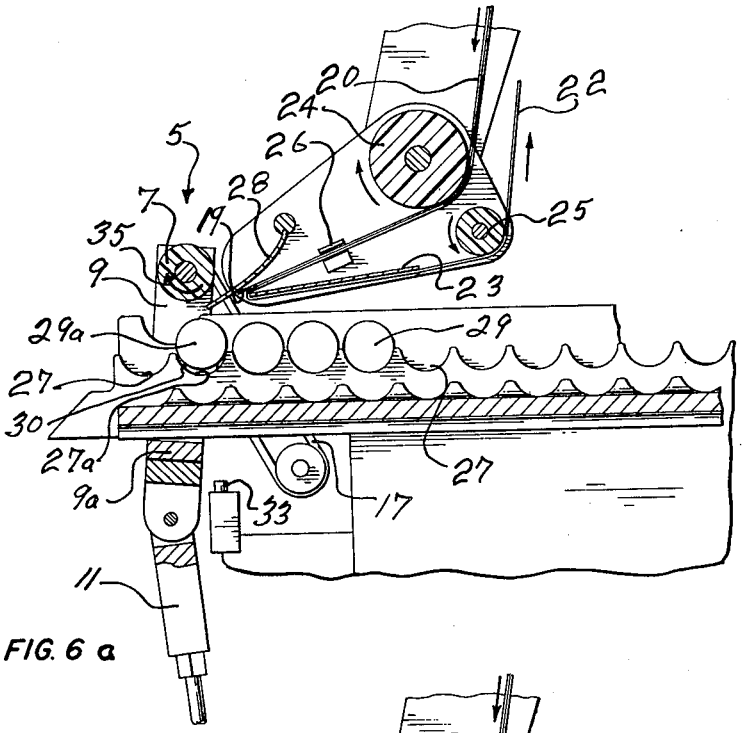
FIGS. 6*a* and 6*b* are sections along 6—6 of FIG. 5 showing the roller in its spaced and contacting positions respectively.
Figure 6B:
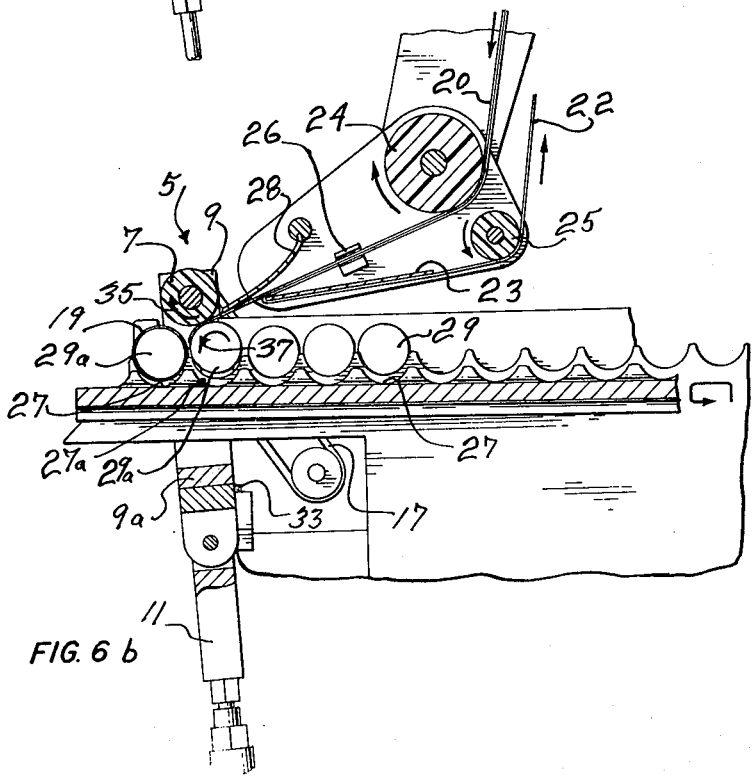

As can be seen in FIGS. 6*a* and 6*b*, the tape is bent back through an angle of substantially 180° by plate 23 at the termination of route 20 and the beginning of route 22. In its travel, the tape passes around guide roles 24 and 25 and through guide means 26.

When the tape passes over the plate 23, the label slips off the tape and is free to be removed from the tape. Plate 28 prevents the freed label from being moved in an upward direction.

The article advancing means can be a walking beam of the type described in applicant's U.S. Pat. No. 3,815,726, issued June 11, 1973. It will be appreciated that other means for advancing the article can be used, and the walking beam is illustrated as a preferred embodiment. The article advancing means comprises plate members 30 having article carrying grooves 27. The articles are advanced along the grooves in a stepwise manner.

The article advancing means includes an article supporting portion 27*a* at the labelling station. Although in the illustrated embodiment the supporting portion is shown as an integral part of the article advancing means, it will be clear that the supporting portion can comprise a separate entity. It is only necessary that the article be supported in such a manner that it is free to rotate at the labelling station. FIGS. 6*a* and 6*b* illustrate a plurality of articles 29 supported in the grooves 27 of the walking beam, as well as an article 29*a* in support means 27*a* at labelling station 5. The groove 27*a* preferably comprises bearings 30 to permit easier rotation of the article in the groove.

Figure 4:
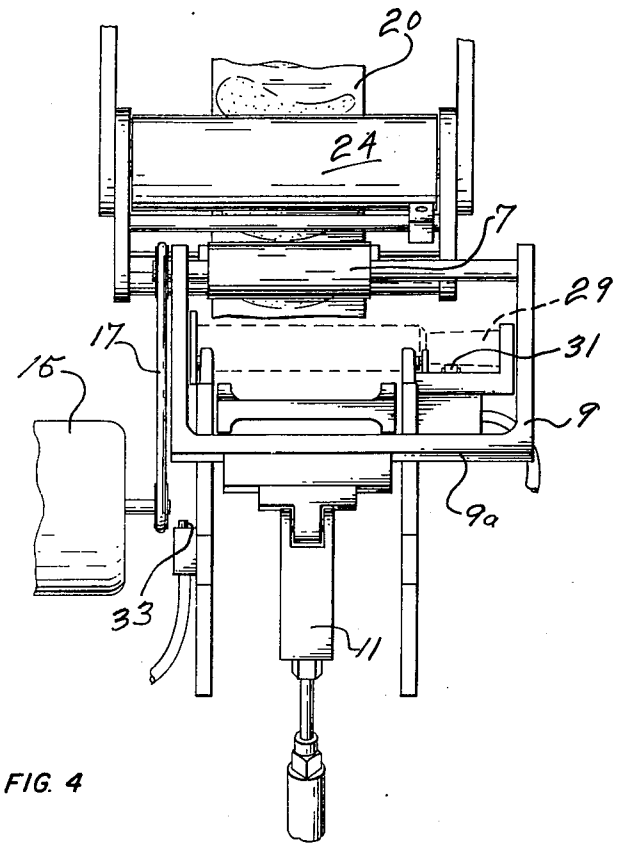
FIG. 4 is an expanded view of the roller means in a position spaced from the article to be labelled to show the relationship of the roller means to the article in this position.

The assembly also includes a switch 31, adapted to be depressed by the article, and a switch 33, adapted to be depressed by the U-shaped bracket (see FIGS. 4 and 6). The switches are connected in series and, when both are depressed, they activate the dispensing means to dispense a label.

In operation, the assembly works as follows:

When the assembly is first activated, the roller is in a first position spaced from the article 27*a* in the labelling station as is shown in FIG. 6*a*. The piston and cylinder arrangement 11 is controlled by the movement of the walking beam such that, each time the beam advances one position, the piston and cylinder arrangement is activated to pull down the U-shaped bracket 9 to a second, contacting position, as is shown in FIG. 6*b*. It is noted that the piston and cylinder arrangement is spring loaded so that the roller 7 will land softly on the article 27*a*.

As mentioned above, the roller is rotated by the motor 15 through pulley 17. This rotation is continuous as is shown in FIGS. 6*a* and 6*b* wherein the arrow 35 indicates the direction of rotation of the roller.

When the roller is pulled down into its second contacting position, as shown in FIG. 6*b*, because the article is free to rotate in the support 27*a*, the action of the roller against the article will cause the article to rotate in the direction indicated by the arrow 37. At the same time, the roller will be tightly pressed against the surface of the article 27*a* to provide pressure at the line of contact between the roller surface and the article surface.

When the roller is pulled down, the pressure on the article forces it downwardly causing it to depress switch 31. At the same time, the bottom bar 9*a* of the U-shaped bracket will depress switch 33 as shown in FIG. 6*b*, so that the dispensing means 3 will be activated to advance the tape 21 through a distance equal to the distance between like edges of two adjacent labels on the tape. This will cause a label to slip off the tape and to be thrust toward the line of contact between the roller and the article in the labelling station.

The purpose of the double switch system is to insure that a label is dispensed only when two conditions obtain, to wit, the conditions that an article is in the labelling station and that the roller is in its second position. With this system, if the article is not in position when the roller is pulled down, a label will not be dispensed. Alternatively, if switch 31 is depressed when the roller is not pulled down, a label will not be dispensed.

When the label is dispensed, it will be gripped at the line of contact between the roller and the article 27*a* by the roller and article. As pressure is exerted by the roller on the article, and therefore on the top, ungummed, surface of the label, the label will adhere to the article. Thus, as the article is rotated, it will pull the label with it to completely remove it from the backing tape. At the same time, as the label passes through the line of contact, it will be pressed against the article surface by the roller, so that finally the entire gummed surface of the label will adhere to the surface of the article.

The assembly is timed to insure that the roller remains in its second position for a period of time equal to the time for at least one complete revolution of the article so that the entire gummed surface of the label will be glued to the article. At the end of this time period, the piston and cylinder arrangement will permit the U-shaped bracket to lift so that roller 7 will assume its first position as shown in FIG. 6*a*. The walking beam will then advance by a further step, the left-most article will be ejected into a collecting means (not shown) and the piston and cylinder arrangement will be activated to pull the roller down to its second position for a second cycle. The operation of the apparatus assembly will, of course, continue for as many cycles as is required to label all articles.

The assembly must be used with cylinder shaped articles which are rotatable in the label station support means. In the drawings, a marker pen was shown as the article. However, it will be appreciated that other elongated cylinder shaped articles could also be labelled with the assembly, e.g., lipstick containers, small vials, etc.

As can be seen, the inventive assembly is simple in construction and operation. It does not require a great deal of extra space, and can be placed at the end of a large number of automatic assembling machines, or could be included as a separate machine to be used at the end of a manual assembly operation. In addition, the assembly is relatively easy to build and maintain.

Although only a single embodiment has been described above, this was for the purpose of illustrating, but not limiting, the invention. Various modifications, which will come readily to the mind of one skilled in the art, are in the scope of the invention as defined in the appended claims.

I claim:

1. A labelling assembly for applying pressure-sensitive labels to the longitudinal surfaces of cylindrical articles comprising;

label dispensing means for carrying labels to a labelling station and for dispensing the labels, one at a time, at the labelling station;

means for advancing said articles to said labelling station;

means for supporting a first article at the labelling station so that the article is free to rotate about its longitudinal axis;

a cylindrical roller means disposed in a two position parallel arrangement with said first article wherein, in one position, said roller is spaced from said one article, and, in the second position, is in physical contact, along a longitudinal contact line, with said first article;

means for moving said cylindrical roller from the first position to the second position and from the second position to the first position;

means for rotating the roller about the longitudinal axis of the roller;

said label dispensing means being adapted to dispense a label adjacent to said contact when said roller is in said second position;

whereby, when said roller is in said second position, it will cause said article to rotate about its longitudinal axis, and the label dispensed by said dispensing means will be rolled around the longitudinal surface of the first article and will be caused to adhere to said longitudinal surface by the pressure of said roller against said first article;

first switch means adapted to be activated by said roller means when said roller means is in its second position; and second switch means adapted to be activated by an article when said roller is in its second position and in physical contact with said article;

said first and second switch means being serially connected to advance said label dispensing means only when both said switch means are activated;

whereby a label will be activated only when said roller means is in its second position and when an article is disposed in a position for labelling.

2. An assembly as defined in claim 1 wherein said means for the articles comprises a walking beam for advancing the articles step by step;

wherein the roller is in its first position when the walking beam is advancing the articles;

and the roller is in its second position after the advancing step.

3. An assembly as defined in claim 2 wherein said means for supporting a first article comprises a stage of said walking beam at the labelling station;

said supporting means comprising bearings to permit rotation of said article in said means for supporting said first article.

4. An assembly as defined in claim 1 wherein said means for moving said cylindrical roller comprises a U-shaped bracket, said roller being rotatably mounted at the free ends of legs of the U of the U-shaped bracket;

and a piston and cylinder arrangement attached to the bottom of the U of the U-shaped bracket.

5. An assembly as defined in claim 1 wherein said labels are carried on a backing tape, said dispenser comprising means for sliding a label off said backing tape at said labelling station.

* * * * *